US006354041B1

(12) United States Patent
Guiles et al.

(10) Patent No.: US 6,354,041 B1
(45) Date of Patent: Mar. 12, 2002

(54) AISLE RISER BACKSTOPS FOR TELESCOPING SEATING SYSTEMS

(75) Inventors: Melvin J. Guiles, Plainwell; Kenneth A. Ahrens, Schoolcraft, both of MI (US)

(73) Assignee: Interkal, Inc., Kalamazoo, MI (US)

( * ) Notice: Subject to any disclaimer, the term of this patent is extended or adjusted under 35 U.S.C. 154(b) by 0 days.

(21) Appl. No.: 09/174,857

(22) Filed: Oct. 19, 1998

Related U.S. Application Data

(63) Continuation-in-part of application No. 08/828,153, filed on Mar. 27, 1997, now Pat. No. 5,822,929.

(51) Int. Cl.[7] ..... E04H 3/12

(52) U.S. Cl. ..... 52/9; 52/183; 182/132; 182/223

(58) Field of Search ..... 52/6–10, 179, 52/182, 183, 188, 288.1, 716.1; 297/452.38, 463.2; 248/345.1; 182/131, 132, 223

(56) References Cited

U.S. PATENT DOCUMENTS

| | | | | | |
|---|---|---|---|---|---|
| 1,545,181 | A | * | 7/1925 | Bechtel | 52/179 X |
| 3,429,081 | A | * | 2/1969 | Robinson et al. | 52/9 |
| 3,667,171 | A | | 6/1972 | McClelland et al. | 52/9 |
| 3,885,144 | A | | 5/1975 | Lewis et al. | 240/2 |
| 4,000,586 | A | | 1/1977 | Vance et al. | 52/9 |
| 4,041,655 | A | * | 8/1977 | Pari | 52/9 |
| 4,045,921 | A | | 9/1977 | Molloy | 52/9 |
| 4,063,392 | A | | 12/1977 | Van Ryn et al. | 52/9 |
| RE29,635 | E | | 5/1978 | McClelland et al. | 52/9 |
| 4,363,197 | A | | 12/1982 | Aurit | 52/9 |
| 4,409,762 | A | | 10/1983 | Raymond | 52/9 |
| 4,518,199 | A | | 5/1985 | Lewis | 297/248 |
| 4,565,036 | A | | 1/1986 | Lyman, Jr. | 52/9 |
| 4,571,895 | A | | 2/1986 | Lyman, Jr. | 52/9 |
| 4,749,191 | A | * | 6/1988 | Gipson et al. | 52/170 X |
| 4,930,277 | A | * | 6/1990 | Krumholz et al. | 52/182 X |
| 5,051,289 | A | * | 9/1991 | Riddle | 52/188 X |
| 5,159,788 | A | * | 11/1992 | Merrick | 52/8 |
| 5,605,025 | A | * | 2/1997 | Paddock | 52/9 X |

* cited by examiner

*Primary Examiner*—Winnie S. Yip
(74) *Attorney, Agent, or Firm*—Raphael A. Monsanto; Benita J. Rohm; Richard A. Gaffin

(57) ABSTRACT

A deployable telescopic seating structure employs a backstop arrangement to prevent users and operators from coming into contact with structure that may cause injury, such as interengaging metal elements that limit the extent of deployment The backstop portions are arrangement in the aisle region of the telescopic seating structure and have an overall height that is responsive to the height of one seating level above another, or in another embodiment, to the difference between such height and an intermediate step. The backstop arrangement has an engagement portion with an edge portion that precludes a discontinuity on the walking surface of tile seating structure. Structural integrity and strength of the riser portion is enhanced by forming same as a multi-fascia structure having a reinforcing corrugation therebetween. A curved back portion along the lowermost edge serves as a termination and additionally adds strength to the backstop arrangement. The backstop arrangement can be formed by bending sheet material or as a continuous extrusion of a polymeric material, such as vinyl, which is fire retardant and which provides injury reducing resilience in the event of impact by a player.

9 Claims, 11 Drawing Sheets

AISLE RISER BACKSTOPS FOR TELESCOPING SEATING SYSTEMS

RELATIONSHIP TO OTHER APPLICATION

This application is a continuation-in-part of U.S. Ser. No. 08/828,153, filed on Mar. 27, 1997, now U.S. Pat. No. 5,822,929, the disclosure of which is incorporated in its entirety herein by reference.

BACKGROUND OF THE INVENTION

1. Field of the Invention

This invention relates generally to deployable seating structures, such as bleachers and the like, and more particularly, to a backstop arrangement for protecting users and operators of the structure from coming into contact with deployment-limiting structure in the aisle area of the seating structure, and from misstepping into a region behind each step in the aisle of the seating structure.

2. Description of the Related Art

A typical conventional telescopic seating arrangement employs a plurality of step portions on which users, such as spectators, are seated at incrementally increasing heights. Usually, there is provided an aisle portion where no seating is provided, but which permits the users to climb as a stair to a desired seating row.

It is a problem with the known arrangements that users or spectators, particularly when the seating arrangement is crowded, will occasionally step beyond a predetermined stepping region, whereupon their shoes may be become caught on structural elements, which include, for example, the interengaging mechanisms that retain the apparatus in a locked and deployed condition. Additionally, it is desired to preclude users and operators of the telescopic seating system from touching or otherwise coming into contact with the interengaging elements whereby serious injury could result.

There is, therefore, a need for an arrangement that prevents users from stepping beyond the predetermined stepping region, but which also does not interfere with the operation of the arrangement between deployed and undeployed states. There is additionally a need for an arrangement that limits access to a deployment limiter that has the potential for causing injury.

In some known arrangements, the various levels of the telescopic seating arrangement are separated by an appropriate seating height that exceeds the height of a conventional stair step. In such arrangements, there is provided an intermediate step that is arranged on the seating level and has a height that is lower than the seating height between the seating levels. Such an intermediate step is generally arranged only in the aisle portion of the telescopic seating arrangement and serves to reduce the likelihood of missteps. Thus, there is a need for a protective arrangement that prevents a user from stepping beyond, or behind, such intermediate step. Additionally, as noted, such a protective arrangement should not interfere with the deployment or withdrawal of the telescopic seating arrangement.

It is, therefore, an object of this invention to provide a deployable telescopic seating arrangement that is provided with a protective arrangement that reduces the likelihood that a user will inadvertently place his or her foot beyond a prescribed stepping area.

It is another object of this invention to provide a protective arrangement that does not interfere with the deployment of the telescopic seating arrangement.

It is also an object of this invention to provide a termination arrangement that reduces the likelihood that a portion of a body of a user or operator of the telescopic seating arrangement will be injured by coming inadvertently into contact with an engagement portion of the arrangement, particularly an engagement portion that interengages forcefully during deployment of the arrangement.

It is a further object of this invention to provide a termination for an edge portion of a seating level of a telescopic seating arrangement, wherein the termination securely engages with the seating level member.

SUMMARY OF THE INVENTION

The forgoing and other objects are achieved by this invention which provides, in a first aspect thereof, a telescopic seating structure of the type having deployed and undeployed states. In accordance with the invention, the telescopic seating structure is provided with a plurality of seating level members arranged in sequentially elevated relation to one another. Each such seating level member is elevated by a first predetermined height over an immediately lower seating level member. Each such seating level member is disposed substantially beneath an immediately superior seating level member in substantially stack relation when the telescopic seating structure is in the undeployed state. However, each such seating level member becomes disposed beneath and forward of an immediately superior seating level member in stepped relation when the telescopic seating structure is in the deployed state. Additionally, there is provided an intermediate step arranged in an aisle region of the telescopic seating structure, the intermediate step being disposed on an associated one of the plurality of seating level members and having a second predetermined height that is shorter than the first predetermined height. There is additionally provided a backstop members having an engagement portion for engaging with a respectively associated one of the coupling arrangements, and a riser portion integrally formed with the engagement portion and arranged to extend downward from the forward region of a respectively associated one of a plurality of seating level members for a distance that corresponds substantially to a difference between the first and second predetermined heights. The riser portion is arranged to have first and second fascia portions arranged above and below a longitudinal corrugation formed in said backstop element. When the plurality of seating level members are in the deployed state, a region between the forward region of the respectively associated one of the seating level members and an uppermost extent of a one of the intermediate steps associated with an immediately lower one of the seating level members is substantially closed.

In one embodiment of this first aspect of the invention, there is provided a plurality of coupling members each are longitudinally arranged along the respectively associated one of the seating level members. The engagement portion of each of the plurality of backstop members are longitudinally arranged along the respectively associated one of the seating level members for a distance therealong that corresponds to a length of an associated one of the coupling arrangements.

In a further embodiment, the engagement portion of each of the plurality of backstop members is provided with an overlying portion arranged to overlie in the forward region of the respectively associated one of the seating level members. Preferably, the overlying portion of each such backstop member is arranged to form a forwardmost edge termination for the respectively associated one of the seating level members. The communication between the backstop arrangement and the associated seating level member is enhanced by a longitudinal flange portion that is integrally formed with the backstop arrangement and extends transversely and downward therefrom to engage into the top surface of the forward region of the respectively associated seating level member. In one embodiment, a plurality of fastener elements fasten the riser portion of the backstop arrangement to the seating level member.

In a further embodiment of the invention, the riser portion of the backstop element is provided with an integrally formed longitudinal curved back portion arranged as a termination of the second fascia portion.

The backstop element is formed of a bent sheet of polymeric material, or alternatively, as a continuous extrusion, illustratively of a polymeric material, such as vinyl.

In accordance with a further aspect of the invention, there is provided a protective backstop arrangement for a telescopic seating arrangement of the type having an interengaging interlock when the telescopic seating arrangement is in a deployed condition. In accordance with the invention, the protective backstop arrangement is provided with a longitudinal engagement portion for communicating with a top surface of a step of the telescopic seating arrangement. A longitudinal edge portion extends parallel to the longitudinal engagement portion, the longitudinal edge having a diminishing thickness characteristic for reducing a height discontinuity between the top surface of a step of the telescopic seating arrangement and the longitudinal engagement portion. Additionally, a longitudinal riser portion is arranged to extend downward from the longitudinal engagement portion. The longitudinal riser portion is formed as a structure having a first fascia portion coupled along one edge thereof to said longitudinal engagement portion, a second fascia portion arranged parallel to said first fascia portion, and a longitudinal corrugated portion arranged to couple the first and second fascia portions to one another.

In one embodiment of this further aspect of the invention, there is additionally provided a curved back portion coupled to the second fascia portion. The longitudinal edge portion, the first and second fascia portions, the longitudinal corrugated portion, and the curved back portion are integrally formed, illustratively of a bent sheet of polymeric material, or alternatively as an extrusion of polymeric material.

In an advantageous embodiment of the invention, the longitudinal corrugated portion is arranged to produce a horizontal offset between the first and second fascia portions. A tread pattern integrally formed with the longitudinal engagement portion.

BRIEF DESCRIPTION OF THE DRAWING

Comprehension of the invention is facilitated by reading the following detailed description, in conjunction with the annexed drawings, in which.

DETAILED DESCRIPTION

Figure 1:
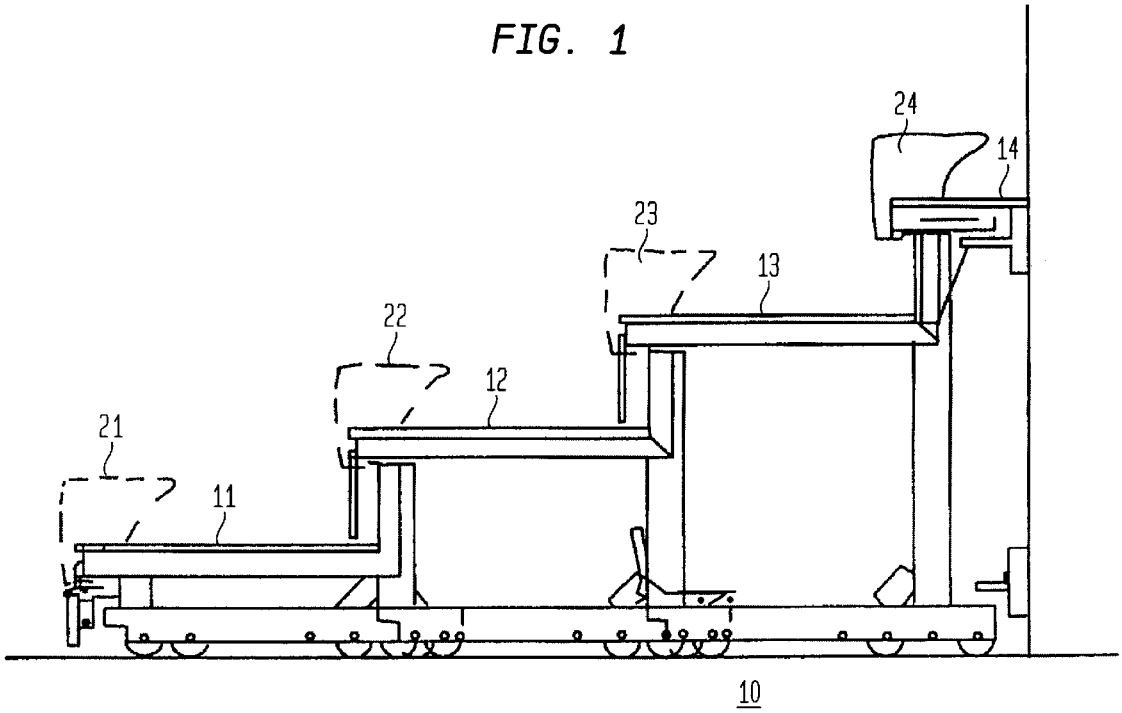
FIG. 1 is a side plan view of a telescopic seating structure constructed in accordance with the invention.

FIG. 1 is a side plan representation of a telescopic seating structure 10 constructed in accordance with the invention. As shown, telescopic seating structure 10 is provided with a plurality of seating level members 11, 12, 13, and 14, each arrangement in sequentially elevated relation to one another by a predetermined seating level height. In this embodiment, each seating level member is provided with an associated one of seating portions 21, 22, 23, and 24. The representation of FIG. 1 is shown in an aisle portion of telescopic seating structure 10 and, accordingly, seating portions 21, 22, and 23 are shown in phantom. The aisle portion is employed by users (not shown) to climb in step-wise, or stair-wise, fashion to a desired seating level.

Figure 2:
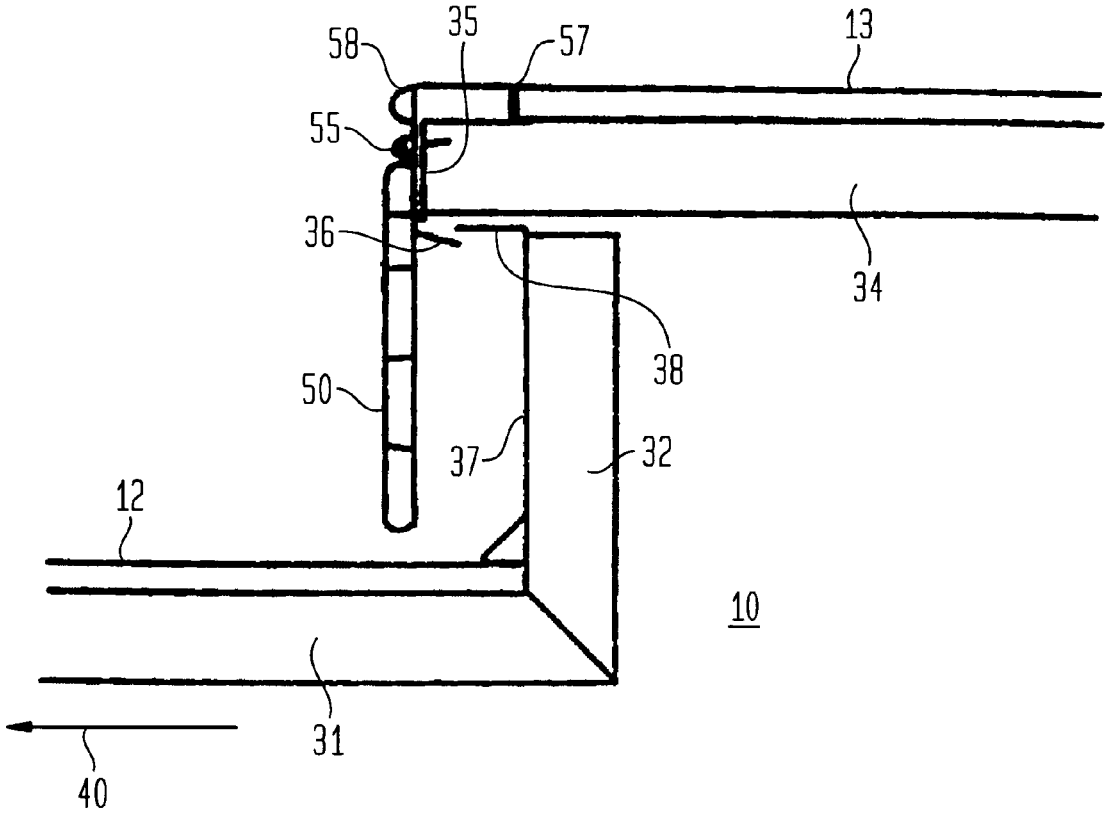
FIG. 2 is an enlarged side plan representation of the embodiment of FIG. 1.

FIG. 2 is an enlarged side plan representation of the embodiment of FIG. 1, specifically showing certain details with respect to seating level members 12 and 13. Seating level member 12 is disposed on a horizontal support member 31 which is coupled at a rear portion thereof to a vertical member 32. Seating level member 13 is similarly disposed on a corresponding horizontal support member 34.

In this specific illustrative embodiment of the invention, horizontal support member 34 is provided with a metal cross member 35 having an associated depending engagement portion 36.

In this embodiment, vertical member 32 has coupled thereto a cross member 37 which serves at its lower portion to secure seating level member 12 in fixed relation to horizontal support member 31, and is additionally provided at its upper end with an engagement portion 38. Thus, as telescopic seating structure 10 is brought into its deployed condition, such as by urging horizontal support member 31 in the direction of arrow 40, engagement portions 36 and 38 are urged to be proximate one another.

As is evident from this figure, it is of critical importance that inadvertent access to the region of engagement portions 36 and 38 be prevented, as serious injury in the form of pinching or cutting could result not only during the deployment process, but also during use, where the shifts in the weight of the crowd of users (not shown) can cause pitching or other motion between the engagement portions even after complete deployment is achieved. In this embodiment, therefore, there is provided a backstop member 50 that will be described in greater detail hereinbelow.

Figure 3:
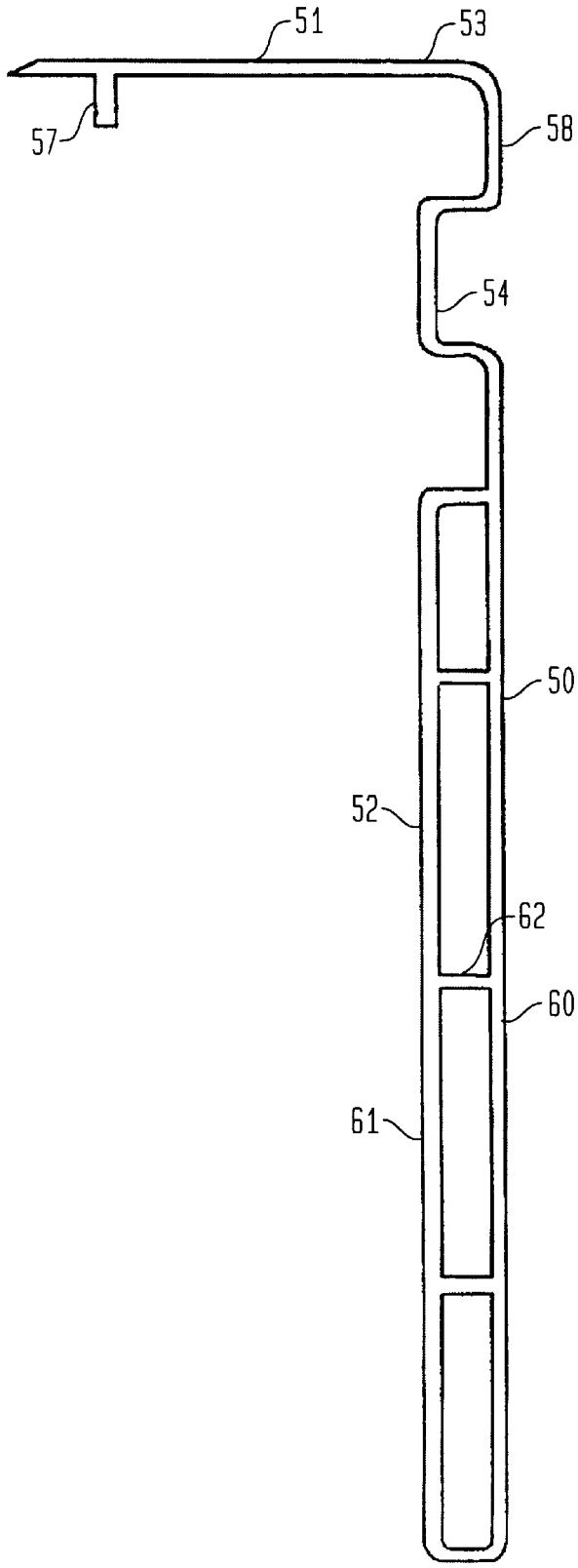
FIG. 3 is a side plan representation of a backstop used in the arrangement of FIG. 1.

FIG. 3 is a side plan representation of backstop member 50. The backstop member is provided with an engagement portion 51 and a riser portion 52 that in this specific illustrative embodiment of the invention is integrally formed with the engagement portion. In this embodiment, the backstop member is formed of a fire retardant material, such as polyvinyl chloride (PVC), and is formed to have a non-slip surface 53 that provides a significant measure of safety. PVC, or similar resilient material, provides the additional advantage of reducing impact, and possibly breaking away in response to a force applied by a player (not shown), whereby when the telescopic seating arrangement is undeployed, players who would impact the backstop member are less likely to be injured. At least some of the impact energy delivered by the player is absorbed by the backstop member, and in many cases, the backstop member will break away before injury to the player will result There is additionally provided a fastening portion 54 arranged intermediate of the engagement portion and the riser portion. The fastening portion facilitates the installation of fasteners, such as fastener 55, shown in FIG. 2. Fastener 55 may be any conventional fastener, such as a screw, a nail, or a rivet, and a plurality of such fasteners are installed along the fastening portion.

Referring once again to FIG. 3, engagement portion 51 is shown to have a descending flange portion 57 which, as shown in FIG. 2, will be disposed between the seating level member, such as seating member 13, and its associated metal cross member 35. As such, the flange portion extends longitudinally and is arranged transverse to the overlying engagement portion 51. The flange portion ensures that engagement portion 51 is not permitted to slide off of metal cross member 35, which could result in tripping and accidental falling of the users.

In addition to the foregoing, overlying engagement portion 51 forms a forwardmost edge termination 58 for its associated seating level member.

The embodiment of FIG. 3 shows riser portion 52 to be formed as an integrated structure having a forward wall 60, a rear wall 61, and a support element 62 arranged transversely therebetween to enhance the strength of the structure. In this embodiment, several such support elements are provided.

In one highly advantageous embodiment of the invention, backstop member 50 is formed as a continuous extrusion of a polymeric material, such as vinyl which is cut to a desired length corresponding to the width of the aisle (not specifically designated) between the seating portions.

Figure 4:
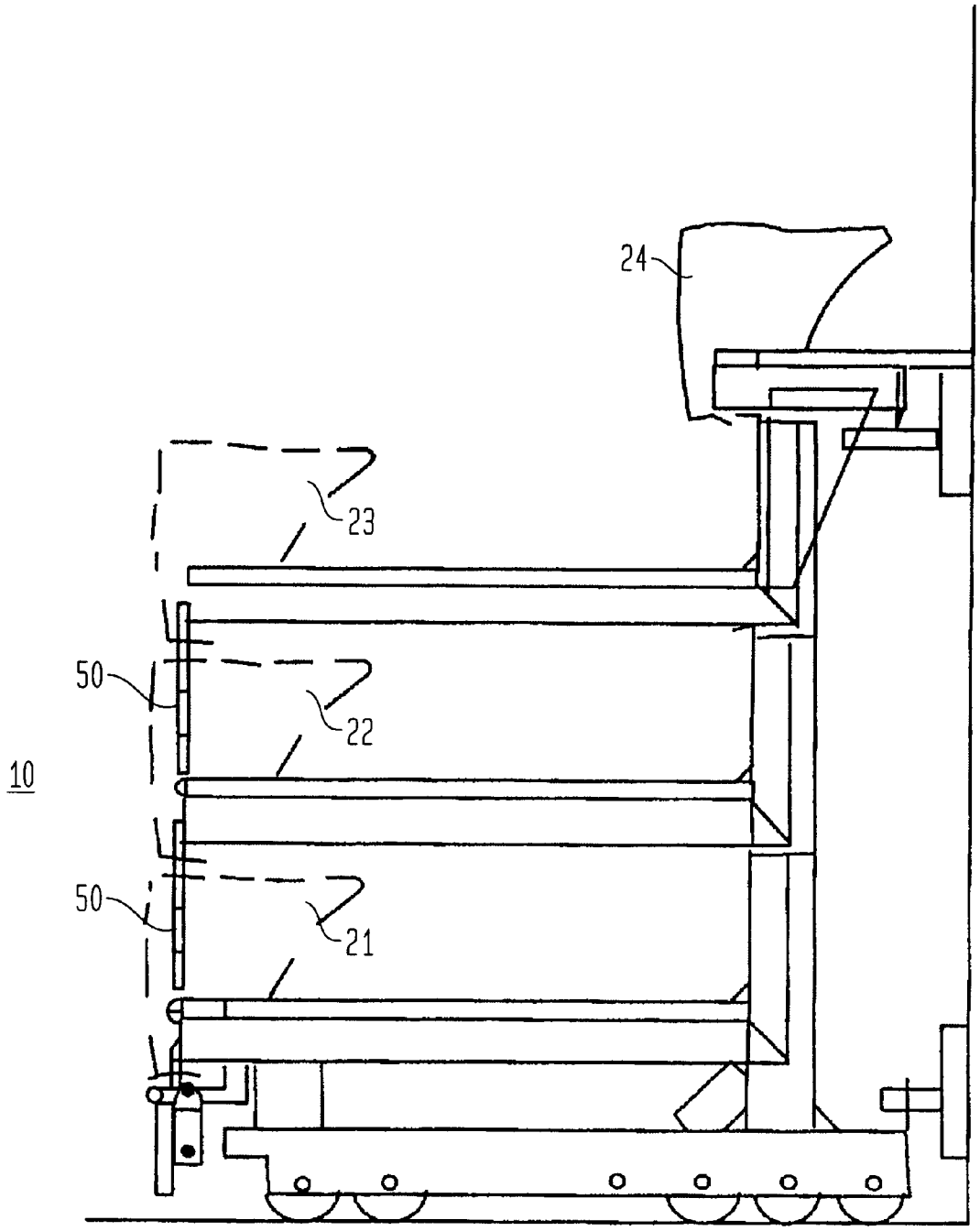
FIG. 4 is a side plan view of the telescopic seating structure of FIG. 1 shown in an undeployed condition.

FIG. 4 is a side plan representation of the embodiment of FIG. 1, in an undeployed condition. As shown, the seating level members are disposed substantially directly beneath one another in substantially stacked relation. This, of course, is in contrast to the deployed state shown in FIG. 1 where each seating level member is disposed beneath and forward of an immediately superior seating level member to form a stepped relation. Backstop members 50 are provided only in the aisle region, as otherwise they would interfere with the seating portions during undeployment of the telescopic seating structure.

Figure 5:
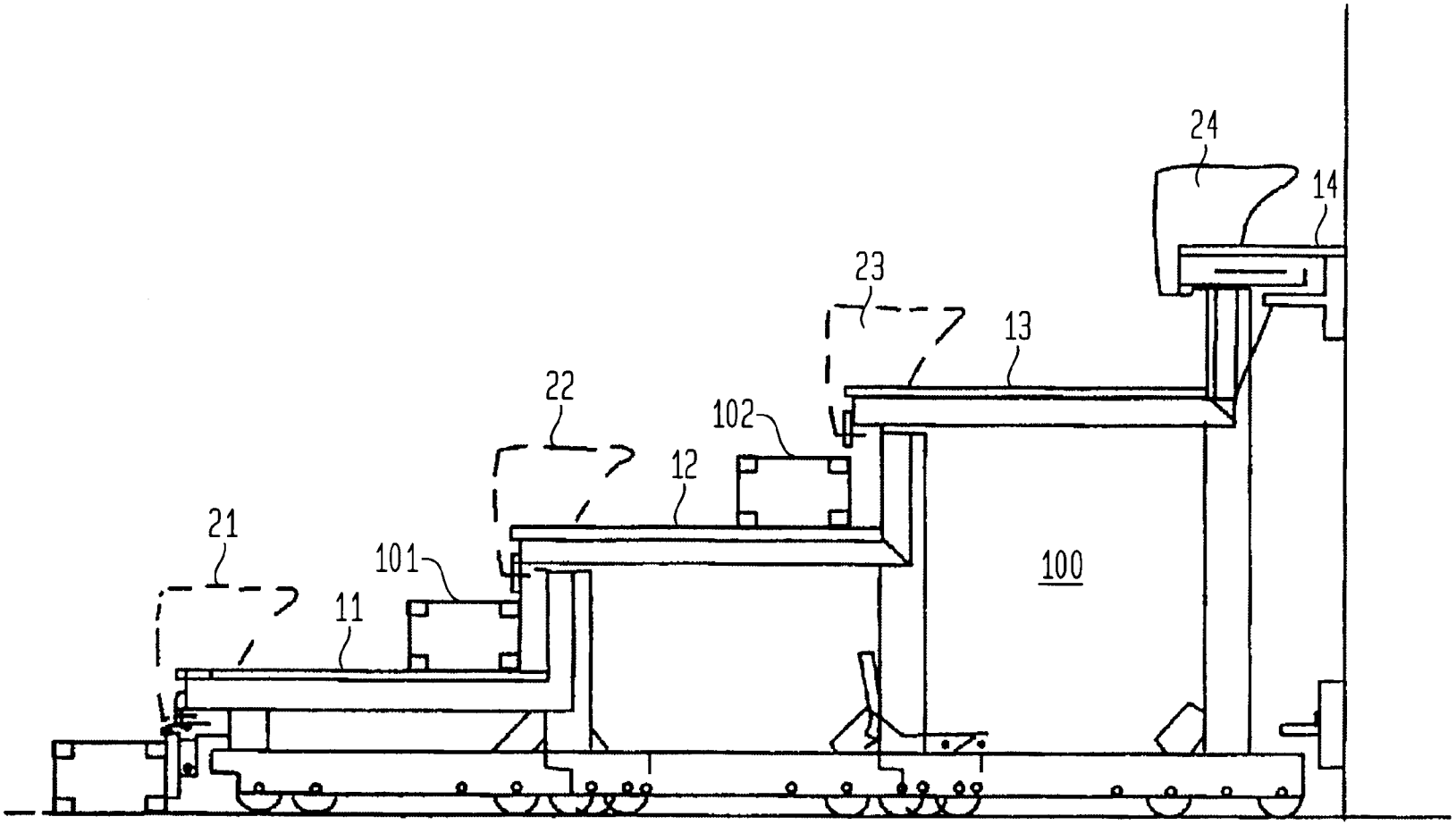
FIG. 5 is a side plan view of a telescopic seating structure constructed in accordance with a further embodiment of the invention.

FIG. 5 is a side plan representation of a telescopic arrangement 100 shown in a deployed condition. Many of the elements of structure of this embodiment of the invention are identical to those discussed hereinabove with respect to FIGS. 1–4 and, accordingly, are similarly designated. In this embodiment, however, there is additionally provided a plurality of intermediate steps 101 and 102 that serve to reduce the overall step height required to be climbed by a user (not shown).

Figure 6:
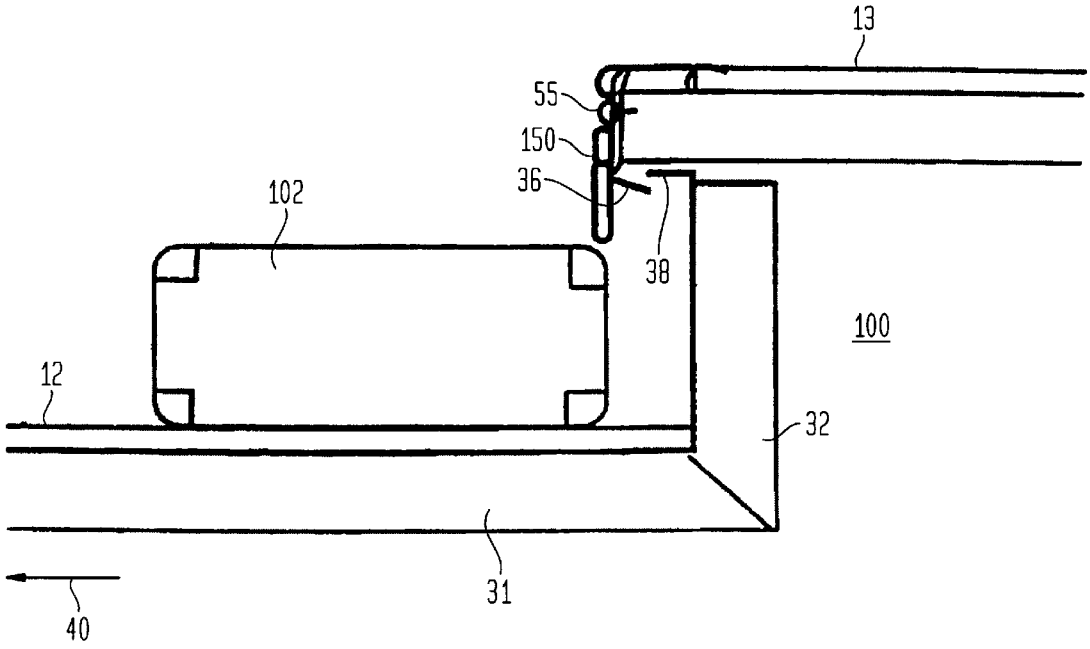
FIG. 6 is an enlarged side plan view of the embodiment of FIG. 5.

FIG. 6 is an enlarged side plan representation of a portion of the embodiment of FIG. 5. As shown, and as previously described, engagement portions 36 and 38 engage with one another when telescopic seating structure 100 is brought into a deployed condition by urging seating level member 12 in the direction of arrow 40. In this embodiment, a backstop member 150 is structurally similar to backstop member 50 described hereinabove, except that its associated riser portion is not as tall. The overall height of the riser portion of backstop member 150 is determined in response to the difference between the height of one seating level member to the other, and the height of the associated intermediate step.

Figure 7:
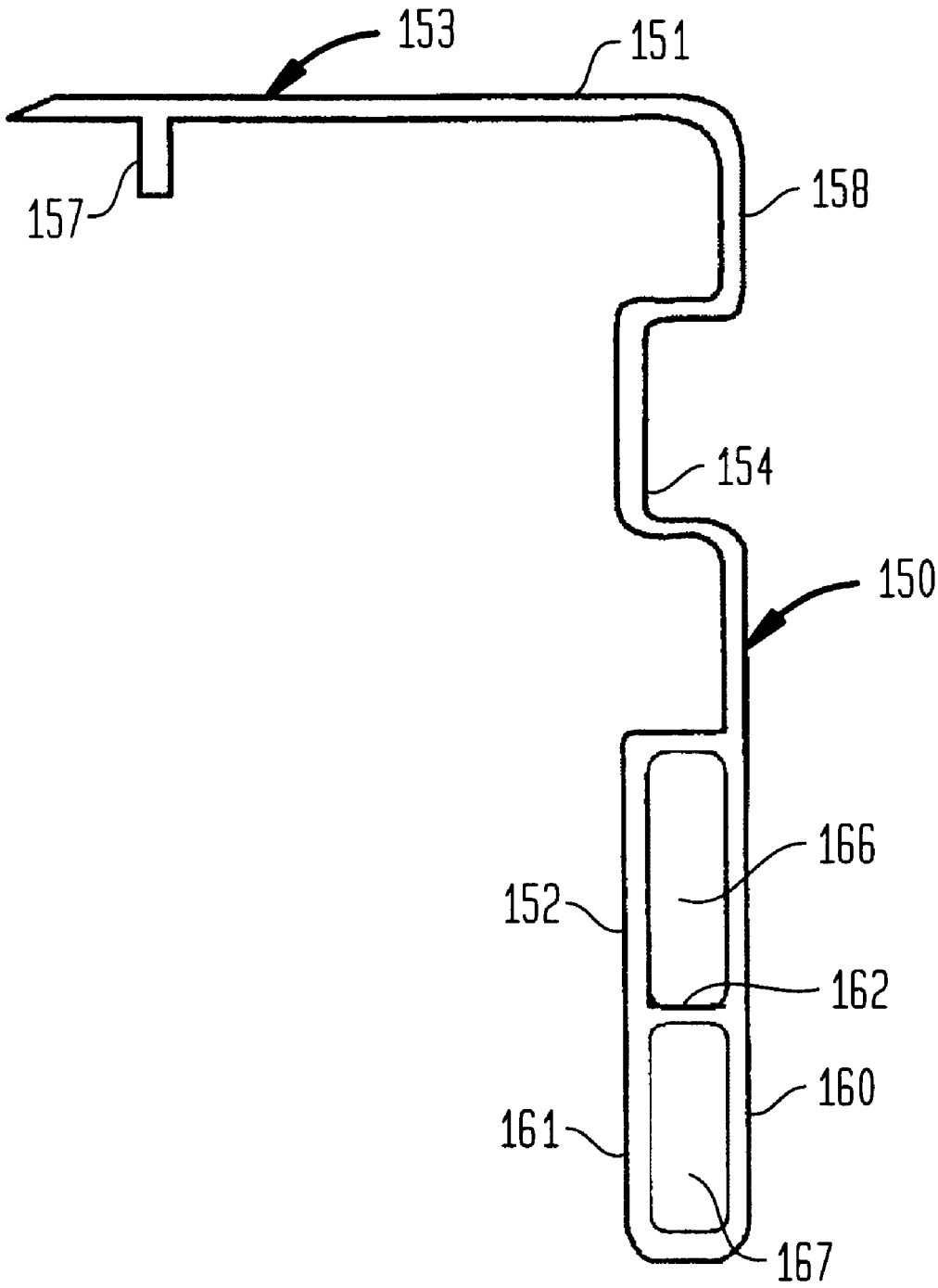
FIG. 7 is a side plan view of a backstop element employed in the telescopic seating structure of FIG. 5
Figure 8:
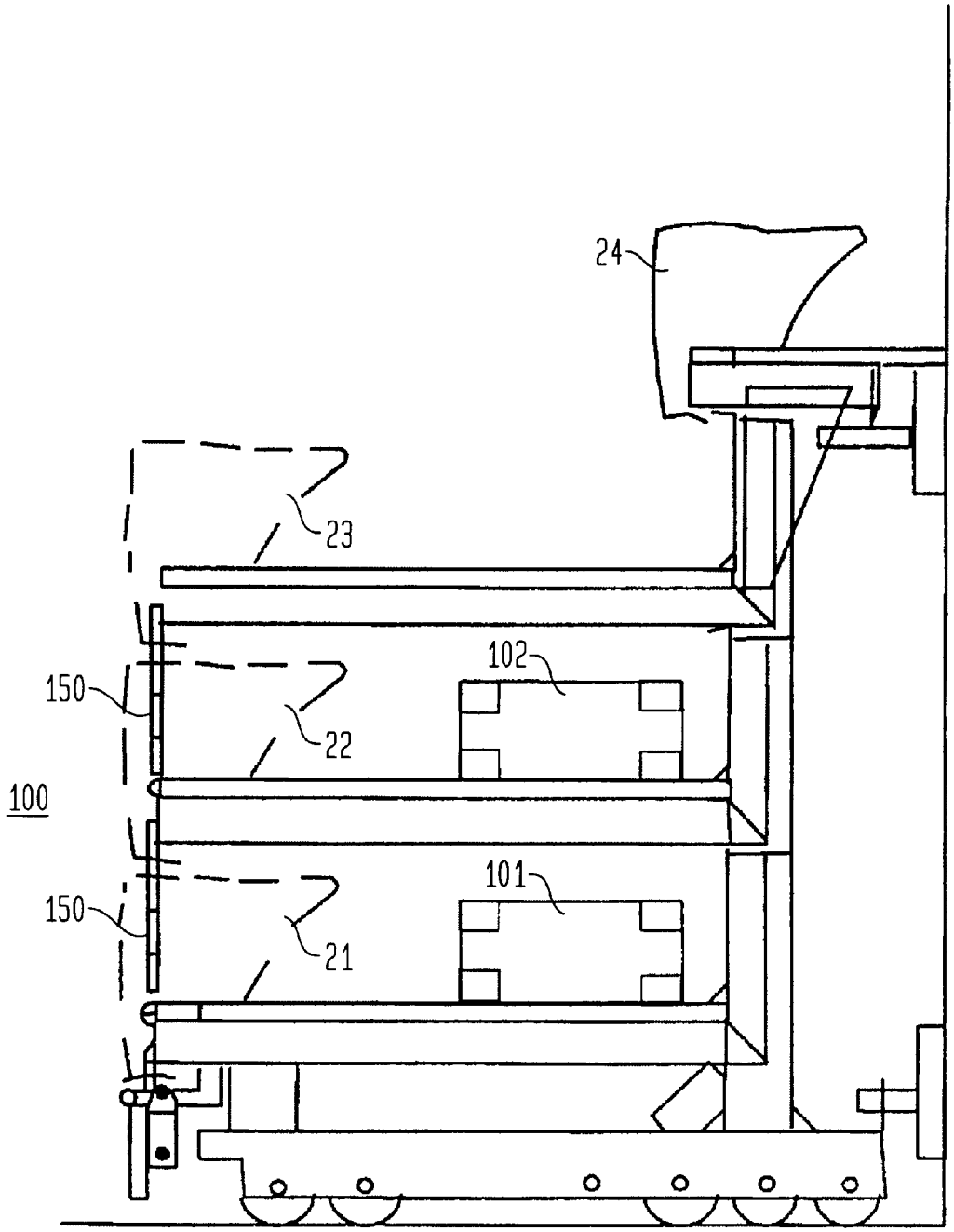
FIG. 8 is a side plan view of the telescopic seating structure of FIG. 5 in an undeployed condition.

FIG. 7 is a side plan representation of backstop member 150 which, as discussed with respect to backstop member 50, is provided with an engagement portion 151 and a riser portion 152. The engagement portion has an associated flange portion 157 and extends forward to form an edge termination 158. A fastening portion 154 is arrangement intermediate of riser portion 152 and engagement portion 151. Also as previously described, riser portion 152 is provided with a rear wall 161 and a forward wall 160, there being provided a support element 162 therebetween. The support element therefore divides the interior volume of the backstop member into two longitudinal chambers, 166 and 167. Also in this embodiment, as discussed hereinabove with respect to FIG. 3, the backstop member is formed of a fire retardant material, such as polyvinyl chloride (PVC), and is formed to have a non-slip surface 153 that provides a significant measure of safety. This provides the additional advantage of reducing impact, and possibly breaking away in response to a force applied by a player (not shown), whereby when the telescopic seating arrangement is undeployed, players who would impact the backstop member are less likely to be injured FIG. 8 is a side plan representation of the embodiment of FIG. 5, shown in an undeployed condition. The shortened riser portions of backstop member 150 ensures that the backstop members do not interfere with intermediate steps 101 and 102 during deployment and undeployment.

Figure 9:
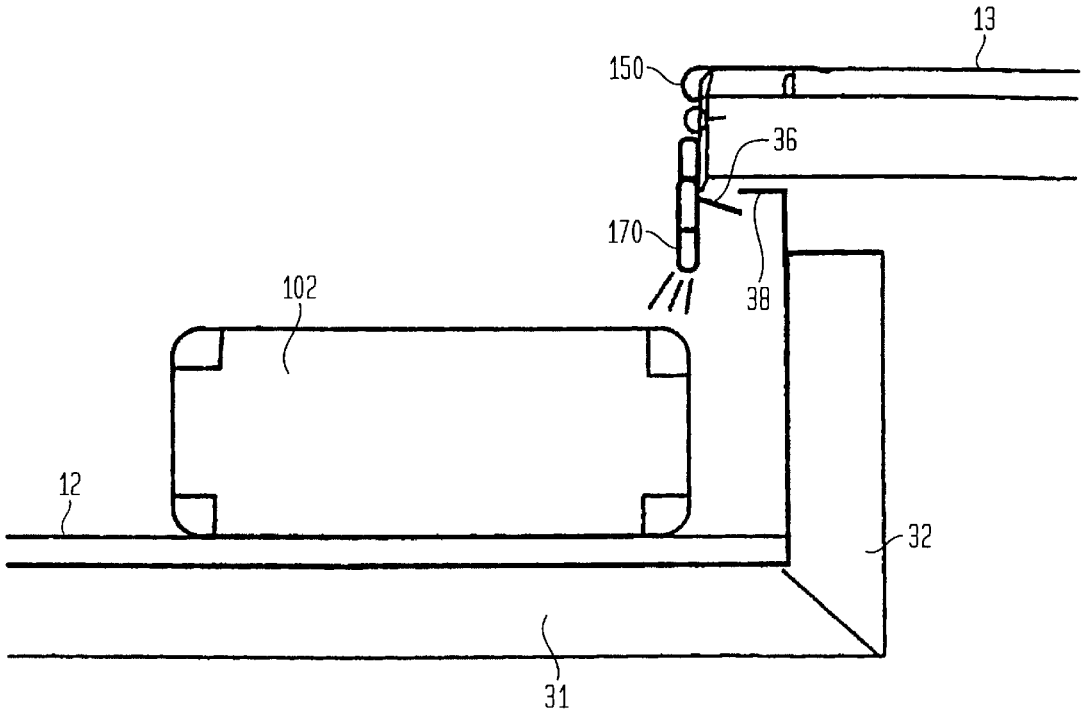
FIG. 9 is a side plan view of an embodiment of the invention having a lighting arrangement incorporated therein.

FIG. 9 is a side plan view of an embodiment of the invention having a lighting arrangement incorporated therein. Many of the elements of structure of this embodiment of the invention are identical to those discussed hereinabove with respect to FIGS. 4 and 6 and are similarly designated. In this embodiment, backstop member 150 has been cut longitudinally, illustratively by a saw, to remove support element 162 and the portion therebelow shown in FIG. 6. Such cutting opens longitudinal chamber 166 (FIG. 6), and in the embodiment of FIG. 9, a lighting strip 170 is installed therein. As shown, the lighting strip, which may be a commercially available continuous lighting product, illuminates the top surface of intermediate step 102, thereby increasing safety.

Figure 10:
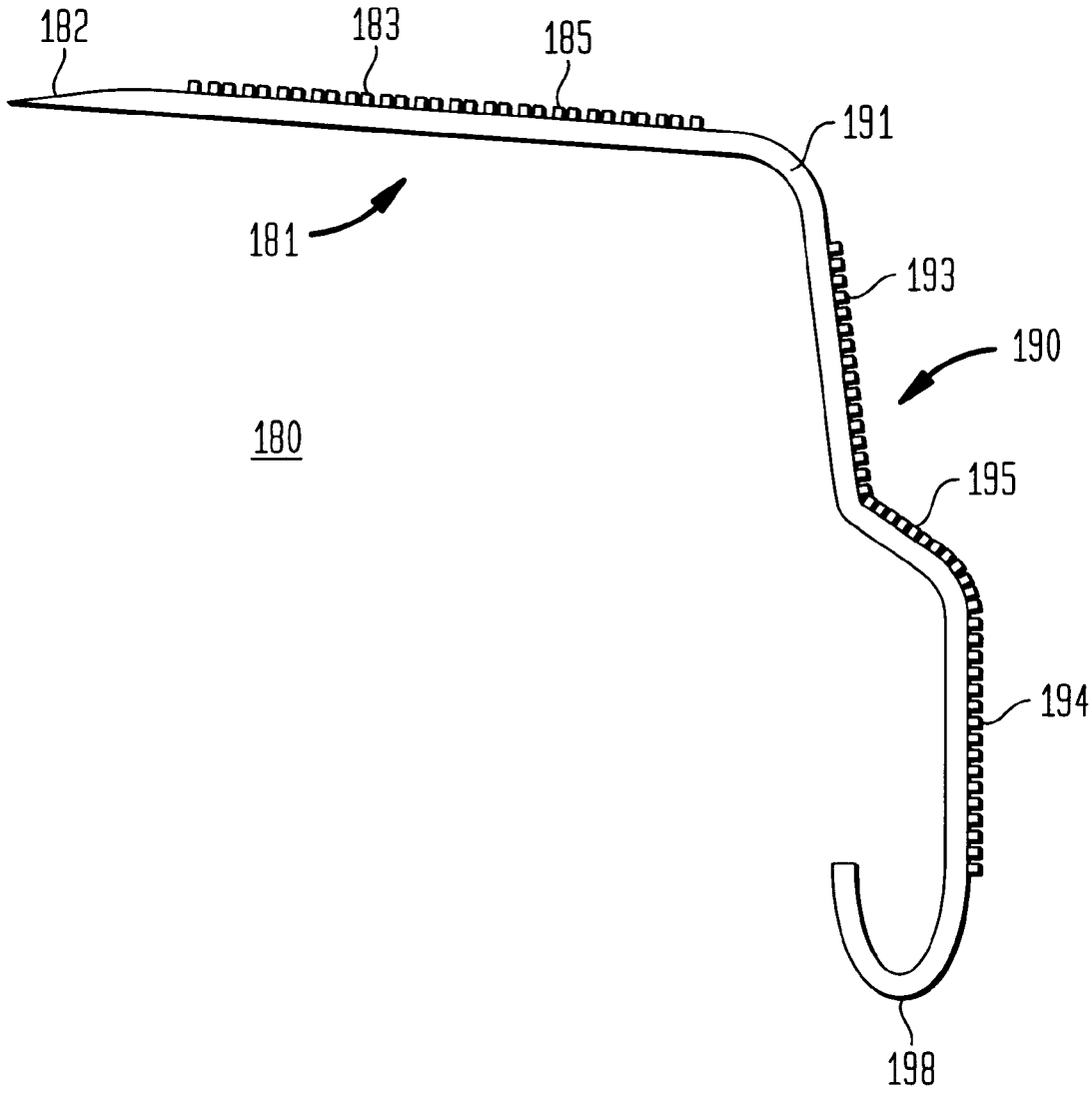
FIG. 10 is a side plan view of a backstop element employed in the telescopic seating structure of the present invention.

FIG. 10 is a side plan view of a backstop element employed in the telescopic seating structure of the present invention. As shown, a backstop member 180 has a top portion 181 with a top surface 183 on which there is integrally formed a tread pattern 185 that is configured to improve a frictional engagement between top surface 183 and the foot sole (not shown) of a user (not shown). A height discontinuity between the top surface of a seating element of the seating structure (not shown in this figure) and top surface 183 of the backstop member is reduced by a sloping edge portion 182. In this specific illustrative embodiment of the invention, top portion 181 is integrally formed with a fascia portion 190 that is coupled to the top portion at a downward bend 191. Fascia portion 190 has first and second fascias 193 and 194, respectively, on either side of a longitudinal corrugation 195, which provides a horizontal offset between first and second fascias 193 and 194.

Figure 11:
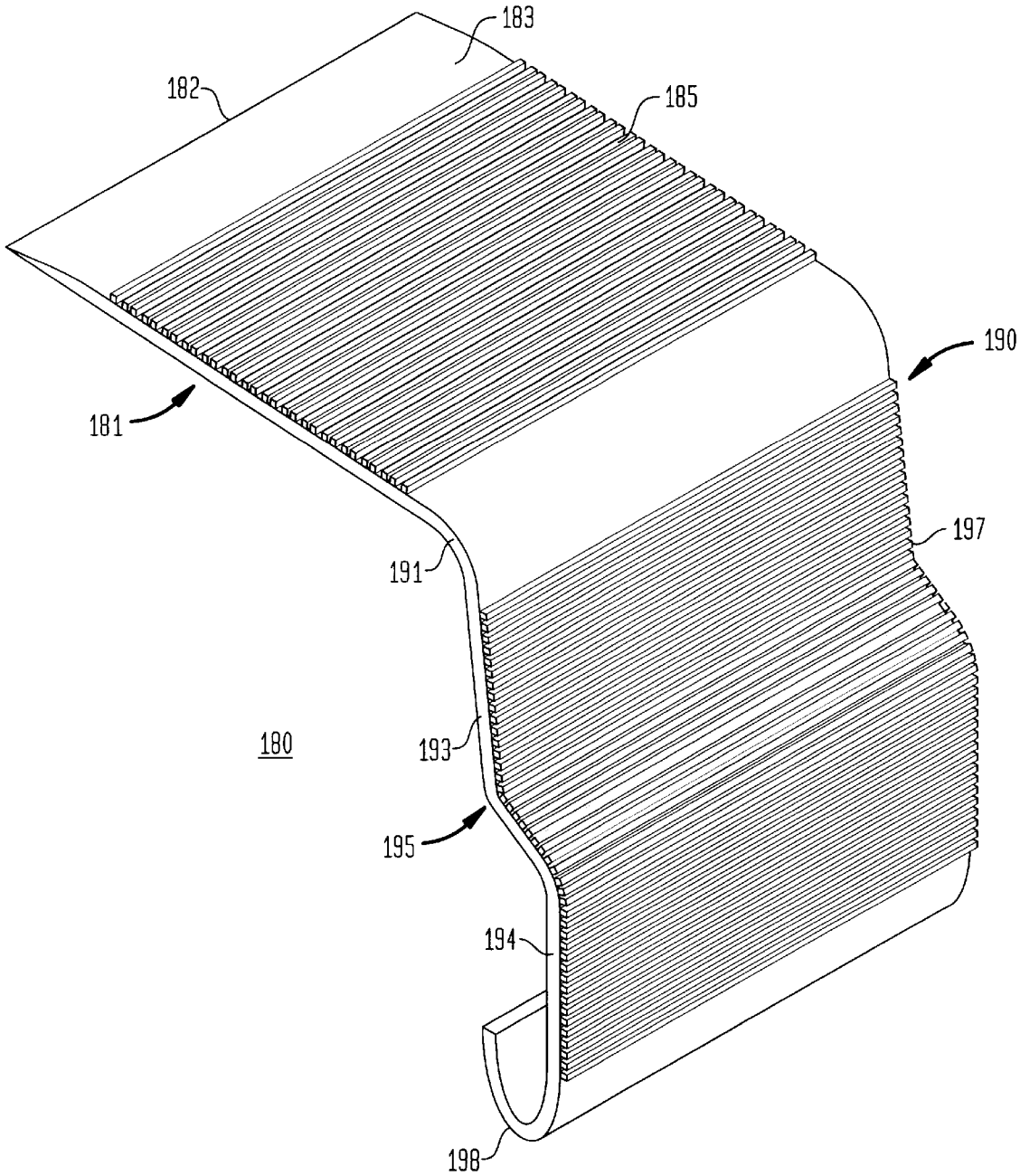
FIG. 11 is an isometric representation of the backstop element shown in FIG. 10.

FIG. 11 is an isometric representation of backstop member 180 shown in FIG. 10. Elements of structure that previously have been discussed are similarly designated. As shown, in this specific illustrative embodiment of the invention, first and second fascias 193 and 194, as well as longitudinal corrugation 195 are covered with a tread pattern 197 that may be similar to tread pattern 185 on top surface 183. Such a tread pattern may, for example, be formed of a plurality of longitudinal tread lines (not specifically identified). Backstop member 180 is further shown to have curved termination 198 whereby second fascia portion 194 is curved back away from the tread patterned surface.

The strength that is afforded by longitudinal corrugation 195 and curved termination 198 obviate the need for extruded arrangements, such as would be the case with backstop member 50 (FIG. 3). Backstop member 180 can economically be formed by a bending process (not shown) applied to continuous strip of a polymeric material, such as vinyl on which has been formed a desired tread pattern and which then is cut to a desired length corresponding to the width of the aisle (not specifically designated) between the seating portions. Alternatively, the backstop member may be formed by extrusion, substantially as previously described with respect to backstop member 50. Backstop member 180 can be attached to the seating level members using fasteners or adhesives.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof

What is claimed is:

1. A telescopic seating structure having deployed and undeployed states, the telescopic seating structure comprising:

a plurality of seating level members arranged in sequentially elevated relation to one another by a first predetermined height, wherein each such seating level member is disposed substantially directly beneath an immediately superior seating level member in substantially stacked relation when the telescopic seating structure is in the undeployed state, and wherein each such seating level member is disposed beneath and forward of an immediately superior seating level member in stepped relation when the telescopic seating structure is in the deployed state;

an intermediate step arranged in an aisle region of the telescopic seating structure, said intermediate step being disposed on an associated one of said plurality of seating level members and having a second predetermined height that is shorter than said first predetermined height; and a backstop element having an engagement portion that is arranged in communication with a respectively associated one of said seating level members, and a riser portion integrally formed with the engagement portion and arranged to extend downward from the forward region of the respectively associated one of said plurality of seating level members for a distance that corresponds substantially to a difference between said first and second predetermined heights, said riser portion of said backstop element having first and second fascia portions arranged above and below a longitudinal corrugation formed in said backstop element, whereby, when said plurality of seating level members are in the deployed state, a region between the forward region of the respectively associated one of said seating level members and an uppermost extent of said intermediate step associated with an immediately lower one of said seating level members is substantially closed.

2. The telescopic seating structure of claim 1, wherein there is further provided a plurality of engagement elements, each being longitudinally arranged along the respectively associated one of said seating level members.

3. The telescopic seating structure of claim 2, wherein the engagement portion of said backstop element is longitudinally arranged along the respectively associated one of said seating level members for a distance therealong corresponding to a length of an associated one of said plurality of engagement elements.

4. The telescopic seating structure of claim 1, wherein the engagement portion of said backstop element is provided with an overlying portion arranged to overlie the forward region of the respectively associated one of said seating level members.

5. The telescopic seating structure of claim 4, wherein there is further provided a plurality of fasteners for fastening the riser portion of said backstop means to said seating level members.

6. The telescopic seating structure of claim 4, there is further provided a lighting arrangement installed in said backstop means.

7. The telescopic seating structure of claim 1, wherein the riser portion of said backstop element is provided with an integrally formed longitudinal curved back portion arranged as a termination of the second fascia portion.

8. The telescopic seating structure of claim 1, wherein said backstop element is formed of a bent sheet of polymeric material.

9. The telescopic seating structure of claim 1, wherein said backstop element is formed as an extrusion of a polymeric material.

* * * * *